US006761340B2

(12) United States Patent
Shaw

(10) Patent No.: US 6,761,340 B2
(45) Date of Patent: Jul. 13, 2004

(54) FURNITURE LEG PROTECTOR

(76) Inventor: John G. Shaw, 4401 Lakeshore Road, Newcastle, Ontario (CA), L1B 1L9

( * ) Notice: Subject to any disclaimer, the term of this patent is extended or adjusted under 35 U.S.C. 154(b) by 0 days.

(21) Appl. No.: 10/292,426

(22) Filed: Nov. 13, 2002

(65) Prior Publication Data

US 2004/0089775 A1 May 13, 2004

(51) Int. Cl.[7] ..... A47B 91/00
(52) U.S. Cl. ..... 248/188.9; 248/346.11; 182/108
(58) Field of Search ..... 248/188.8, 188.9, 248/346.11; 182/108

(56) References Cited

U.S. PATENT DOCUMENTS

| | | | | | |
|---|---|---|---|---|---|
| D44,952 | S | * | 12/1913 | Buser | D8/374 |
| 1,382,833 | A | * | 6/1921 | Hurd | 182/108 |
| 1,482,205 | A | * | 1/1924 | Uhl | 248/188.9 |
| 1,600,103 | A | * | 9/1926 | Evans | 182/108 |
| 1,982,138 | A | * | 11/1934 | Herold | 248/346.11 |
| 2,595,961 | A | * | 5/1952 | Layne | 248/346.11 |
| 2,865,133 | A | * | 12/1958 | Hoven et al. | 248/188.9 |
| 2,968,116 | A | * | 1/1961 | Arenson | 248/188.9 |
| 2,994,152 | A | * | 8/1961 | Donahue | 248/188.9 |
| 3,183,545 | A | * | 5/1965 | Bergstrom | 16/42 R |
| 3,199,819 | A | * | 8/1965 | Widmark | 248/188.9 |
| 3,865,050 | A | * | 2/1975 | Cecchetti | 108/19 |
| 5,123,558 | A | * | 6/1992 | Moloney | 220/212 |
| 5,141,076 | A | * | 8/1992 | Joyce et al. | 182/108 |
| 5,427,342 | A | * | 6/1995 | Gagnon | 248/188.9 |
| 6,563,055 | B1 | * | 5/2003 | Burdick | 174/158 F |

* cited by examiner

*Primary Examiner*—Leslie A. Braun
*Assistant Examiner*—Jon Szumny

(57) ABSTRACT

A leg base for outdoor furniture for fitting on the end of a leg and acting as a boot to permit sliding of the leg and to protect it from damage, and having a wall structure shaped to embrace the leg around its end, a floor secured to the wall structure and, a generally convex lower surface formed on floor, for standing on a substrate.

6 Claims, 4 Drawing Sheets

FURNITURE LEG PROTECTOR

FIELD OF THE INVENTION

The invention relates to outdoor wooden furniture, and in particular to a leg base or foot or boot, on the lower end of each leg, to act as a skid or a sort of "sled" and/or sometimes as a protector for permitting easy sliding of the furniture without damage to the lawn or other substrate, while preventing splitting of the end grain of the legs, and also for reducing or preventing rotting of the lower ends of the legs of outdoor furniture due to standing in damp or wet conditions on a lawn or beach, or other substrate.

BACKGROUND OF THE INVENTION

Wooden furniture is often used and left standing outdoors. Usually such furniture is left on a lawn or beach for example. A lawn is moist in almost all conditions, as a result of weather conditions, watering, and of course the dew which forms overnight. In these conditions the lower ends of the legs are often permanently damp or even standing in pools of moisture.

Wood is easily rotted in these conditions. The lower ends of the legs are "end grain" lumber, which causes wicking of moisture up into the leg. Due to wood rot such furniture will have a relatively short useful life, and will soon have to be thrown away and replaced. Attempts have been made to treat such wood products with chemical rot proofing compounds. Most of such compounds have a content of arsenic, which is a hazardous and contaminant material. It is now found the arsenic leaches from the wood and forms toxic contamination of the environment. It is now preferable to make outdoor furniture such a tables and chairs out of untreated lumber such as spruce or cedar. Accordingly these solutions are now avoided where possible. This is so whether such treatment is so-called pressure treated or is simply applied by dipping or spraying. Even when so treated, the legs will rot out quickly when left standing in moisture, leaving no alternative but to replace the furniture. The legs are cut from stock lengths of lumber and when cut this exposes the interior of the lumber which is in any case untreated, so the pressure treatment of other treatment is ineffective in the very area where it would be most needed namely the lowers ends of the legs.

This is both wasteful of resources and also unnecessarily expensive.

The upper portions of the furniture out last the legs by many seasons, due to the free air circulation, and suns ray, around them, ensuring that they dry out and do not stand in moist conditions.

However unless replaced before it falls apart such furniture can be dangerous. Another problem with this type of furniture, whether it be wooden chairs or tables or the like, is that it forms an obstruction on a lawn or beach. A lawn will have to be mowed regularly. A beach may require raking or some type of maintenance. Wherever such furniture is used it will have to be moved around from time to time if only to rearrange its grouping.

For this type of situation, wooden furniture must be dragged around into a new grouping or a new position, or even in some cases simply removed to permit a thorough job to be done. Ideally moving such furniture is a two person job. However in many cases there is no chance to wait for a second person to come and assist. Moving the furniture is thus usually done by the person mowing the lawn, alone.

Functions as simple as merely moving the furniture to relocate it from one place to another, poses problems with this type of wooden furniture. The legs frequently dig in to the lawn and tear up the turf. On a beach the legs may sink in making it impossible to drag around. As the legs are dragged they act like a plow digging up turf and beach. Also, as the legs are dragged, the load on for example two legs being dragged is now doubled compared with the load on four legs. As a result organic material is forced up into the end grain causing still further rotting. On a deck or patio the legs may catch in decking, or on flagstones and the like.

Dragging such furniture over flagstones may easily dislodge the flagstones and disturb the surface of the patio.

Also the act of dragging such furniture strains the legs. The racking of the legs in this way can loosen the fastenings in the entire piece of furniture. Over time the fastening of the legs, and also the table top, seats or the like of the furniture becomes loose. It is then unsafe. This adds still further to the need for regular replacement.

BRIEF SUMMARY OF THE INVENTION

With a view to satisfying the foregoing objectives the invention in one aspect comprises a leg base for outdoor furniture for fitting on the end of a leg and acting as a boot to permit sliding of the leg and to protect it from damage, and having a wall structure shaped to embrace the leg around its end, a floor secured to said wall structure and, a generally convex lower surface formed on said floor, for standing on a substrate.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Referring to FIGS. 1 to 7 the invention is there illustrated in the form of a leg base (10). In this embodiment the base (10) is designed for use with furniture of the type having legs at an angle offset from the perpendicular. Typically such furniture will include for example outdoor wooden tables, typically picnic tables. It would also be applicable to some forms of outdoor wooden chairs, having some legs which are at such an angle. Such furniture is well known and requires no special description.

Other forms of leg base can be designed for use with other types of furniture having legs which are perpendicular, or which are set at angles different from that shown in FIGS. 1 to 7. All such applications are deemed to be included within the scope of this invention, without limitation to any specific angle.

Figure 1:
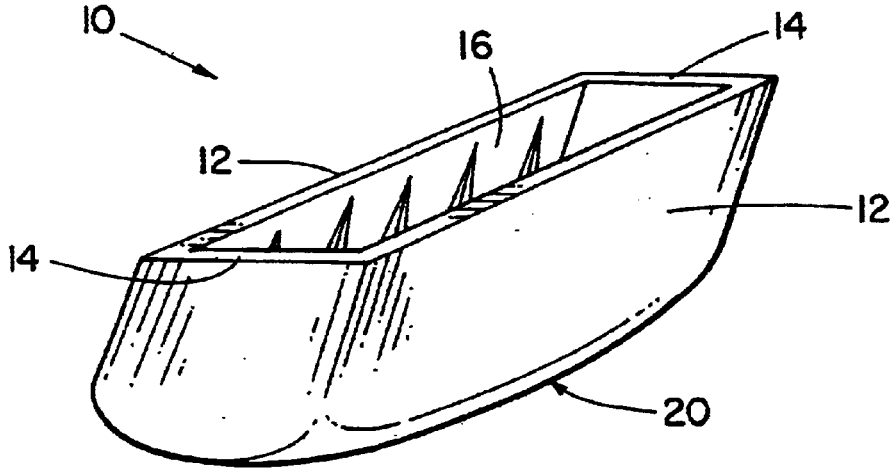
FIG. 1 is a perspective of a leg base illustrating the invention.
Figure 2:
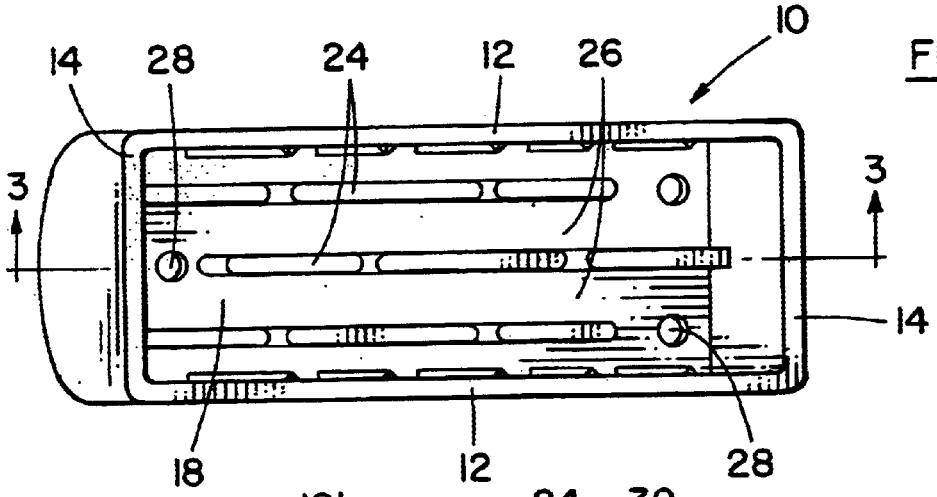
FIG. 2 is a top plan view of FIG. 1.

As shown in FIG. 1 the leg base in this embodiment is illustrated as (10). Base (10) has a wall structure to embrace the end of a leg of furniture. In this embodiment the wall structure comprises two side walls (12) and two end walls (14). The side and end walls enclose a generally rectangular well (16). The rectangular configuration is chosen here merely by way of illustration.

Figure 3:
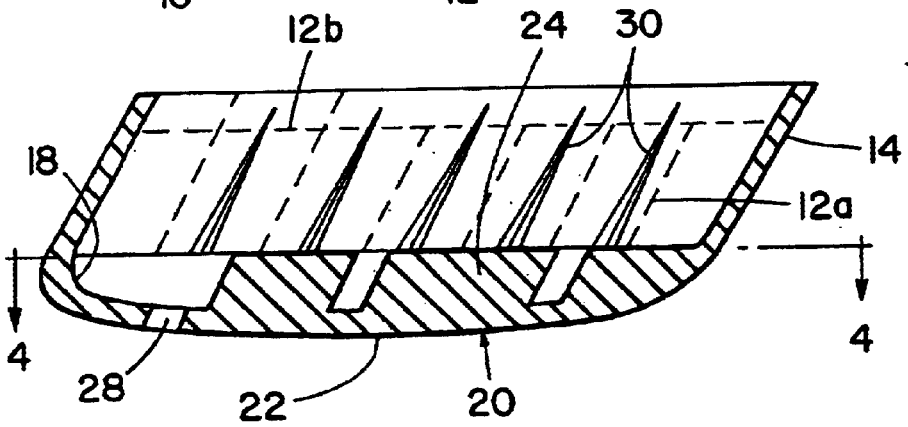
FIG. 3 is a section along line 3—3 of FIG. 2, and showing in phantom an alternate form of wall structure.
Figure 4:
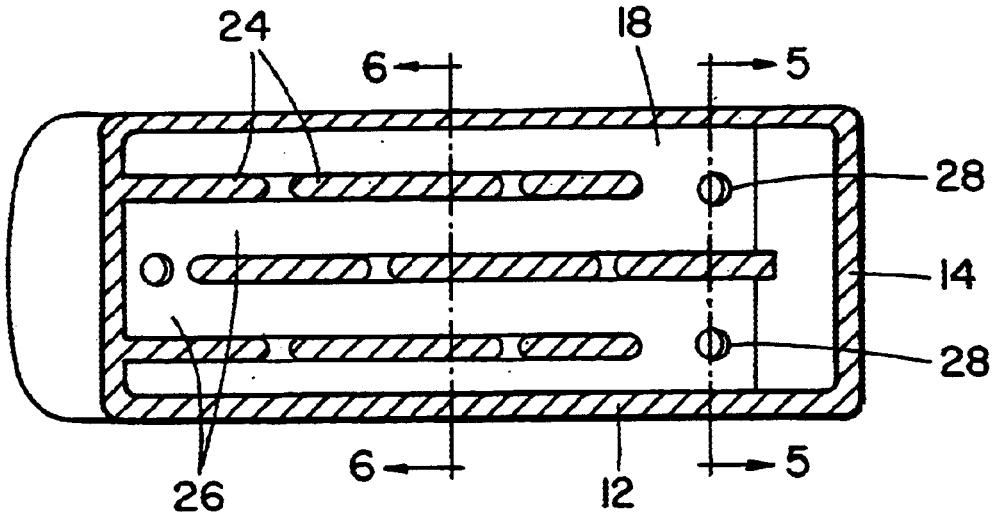
FIG. 4 is a section along line 4—4 of FIG. 3.
Figure 5:
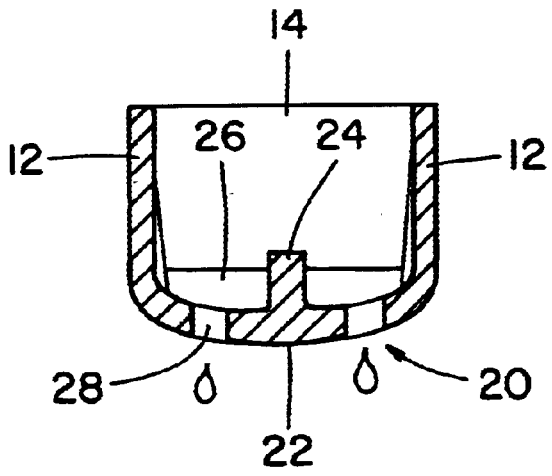
FIG. 5 is a section along line 5—5 of FIG. 4.
Figure 6:
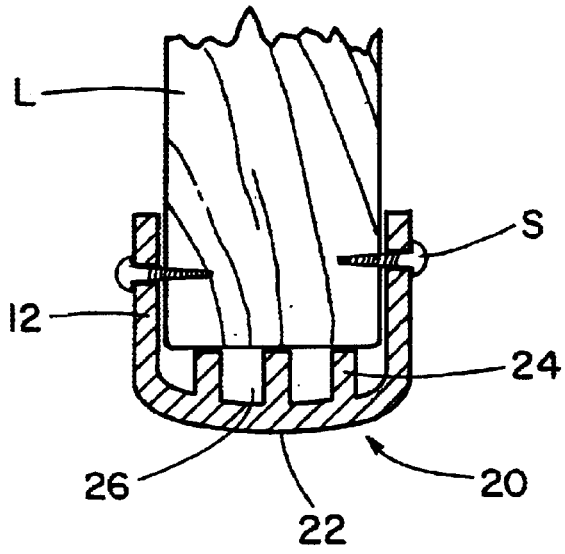
FIG. 6 is a section along line 6—6 of FIG. 4
Figure 7:
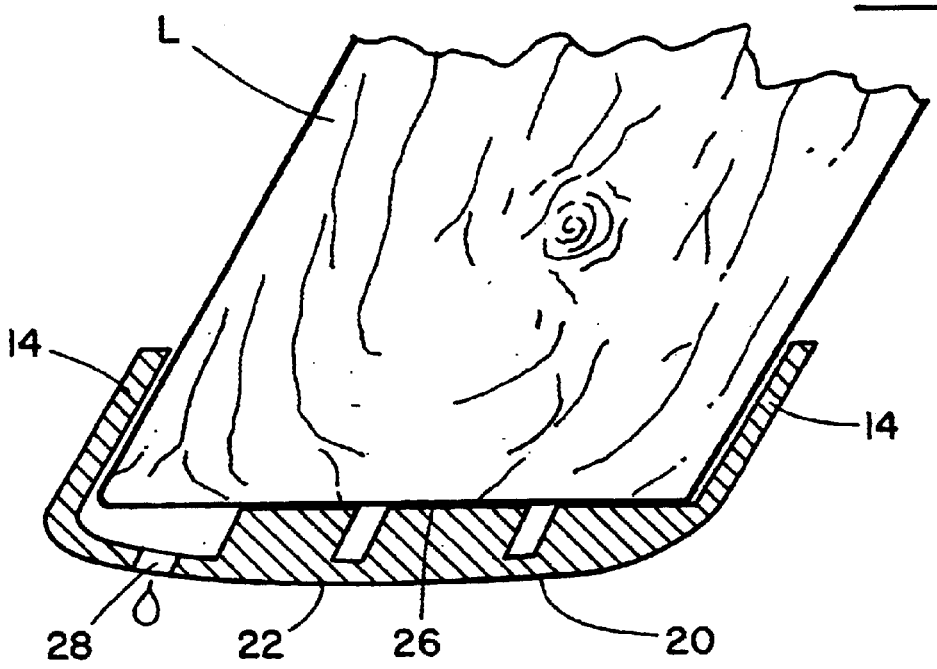
FIG. 7 is a section similar to FIG. 3 showing the base applied to an article of furniture of the type having angled legs.
Figure 8:
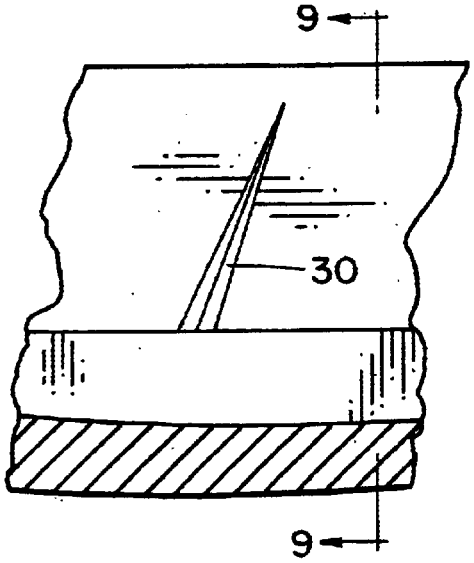
FIG. 8 is a detail of an alternate embodiment.
Figure 9:
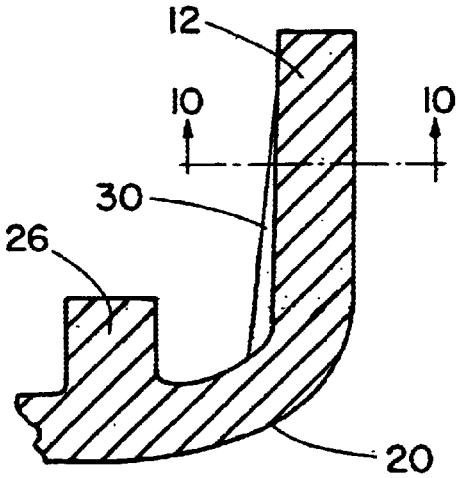
FIG. 9 is a section along line 9—9 of FIG. 5.
Figure 10:
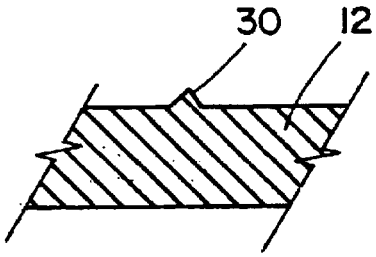
FIG. 10 is a section along line 10—10 of FIG. 9.
Figure 11:
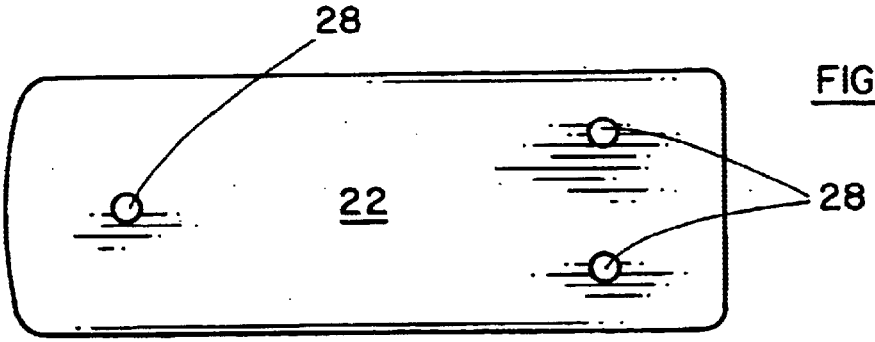
FIG. 11 is a bottom plan view.

This shape is selected to accommodate a leg L (FIG. 7) of generally rectangular shape in section. However if the legs were non-rectangular, or cylindrical, for example the well (16) would be so formed as to conform to the section of that leg. The well (16) defines an open top for reception of a lower portion of leg L. Other forms of wall structure are possible, and it may be that the wall structure can be formed as a frame work or as struts, embracing the end of the leg. One such alternate wall structure is shown in FIG. 3.

In this case the walls are formed on spaced apart wall columns 12*a*, defining air gaps between them, and a wall brace bar 12*b* joining the upper ends of columns 12*a*. In this way the wall structure embrace leg securely but at the same time permits free air circulation to keep the wood dry.

The lower end of well (16) is closed off by a floor wall (18). Wall (18) defines an exterior downwardly directed load bearing surface or profile (20) which is preferably of convex shape. Preferably, for reason to be described, the surface (20) is smoothly curved from a central area (22) of maximum depth, and curves smoothly upward and outward in both transverse and longitudinal axes until it reaches its periphery. The central area (22) is designed to stand at ground level, or on any elevated surface, on any type of surface or substrate. This surface could simply be on the ground, whether it be covered with turf, or plain earth, or sand, or it could stand on an artificial outdoor surface such as a patio, balcony, flagstones, bricks, tiles, wooden decking, concrete, artificial turf, tarmac, or any other exterior surface, whether natural or artificial. For the sake of simplicity all such surfaces and substrates are referred to collectively herein as "ground". It will be understood that this term is without limitation and includes any substrate surface on which an article of furniture may stand.

The convex shaping of the surface (20) allows the furniture to be picked up at one end, and dragged about on only two legs. Since the surface (20) is convex, tipping the furniture up to lift one pair of legs, will cause rocking of the other two legs. The convex surface (20) allows this rocking or tilting, and this in fact enhances to ease with which the furniture may be dragged from place to place. When tilted up the base surface (20) acts as a sort of skid or sled. The leading edge of the surface (20), ie the edge which is leading in the direction in which the furniture is being dragged, will raise up and tend to ride over any obstruction. It will enable the base to slide easily over the surface of a lawn or beach for example, without digging in a causing damage. This will be so whether the furniture is dragged by holding one end, or by holding one side. The convex formation of the surface (20) allows it to rock either transversely or longitudinally. Within the interior of well (16) there are formed several ribs (24) standing up from the inner, upper surface of floor (18). Ribs (24) are separated by channels (26) for drainage of moisture. A drain opening, or openings (28) are formed from the channels (26) through floor (16) and communicate with the exterior convex surface (20) of floor (16), permitting moisture to flow freely therefrom onto the substrate on which the base (10) standing. The ribs (24) and the channels (26), and the drain holes (28) also promote air flow around the end of the leg. This assists in drying out the end of the leg if it becomes moist and assists in preventing rotting.

The channels (26) will be suitably inclined so as to promote such drainage. The openings (28) are located offset away from central area (22) of the convex surface (20) so as to permit free flow of moisture when the central area (22) may have sunk somewhat into the ground, or lawn or sand. By placing the drain openings (28) offset from such central area, the openings are less likely to become blocked in such conditions.

In this embodiment the side walls (12) and end walls (14) define planes which are angled offet to the perpendicular. The purpose is to adapt the angles of the walls to accommodate the typical leg L of, for example, a wooden picnic table. In operation four such bases ( ) are slid onto the lower ends of respective legs L of a four-legged picnic or outdoor table, in this example.

The convex surfaces (20) of the respective bases (10) will then stand on the ground, or any other surface. The ends of the legs L will thus be supported clear of the ground or surface. Any moisture which accumulates on the ground will not seep up into the wells (16) of the bases. Any moisture which runs down the legs and flows into the wells, will simply drain out to the exterior and flow onto the ground.

Obviously, in exceptional cases, such as flood, whether natural or man-made, or accidental, will not be capable of being "drained" in this way since the water level surrounding the furniture would be above the height of the floor of base. This is deemed self-evident and requires no explanation. Such events are rare, and cannot be addressed by this, or other inventions.

The base (10) may be secured to the leg by means such as (S). FIGS. 8, 9, 10, and 11 illustrate another feature of the product.

This feature provides inwardly directed ridges (30), formed on the inward surfaces of side walls (12). The ridges are of generally triangular shape in section. Preferably the ridges (30) are slim at their upper ends and become progressively larger as they extend down to the floor. The ridges start about the mid point of side walls (12) and extend down to the floor. They are designed to make a tight fit with the leg and will bite into the wood, to hold the base from becoming loose when the furniture is moved.

This feature is desirable to accommodate variations in the actual dimensions of the cross sections of lumber in different pieces of furniture, from different sources.

Nominally such lumber is usually say 2"×4". However as is well known finishing of the lumber may remove more or less of the outside layer.

The actual dimension of the crosssection are more usually about 1½"×3½". Even this will vary from one lumber mill to another.

By using the ribs (30) the lumber is tightly held in the well. The side walls of the well are secured by screws S. The end result is that the bases are securely and tightly fastened to the ends of the legs and can accommodated reasonable variations in lumber dimensions without losing their grip.

The base may also be formed for furniture with perpendicular legs. In this case the side and end walls of the base would all be perpendicular. The remaining details of the base would be essentially the same as described. The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A leg base for outdoor furniture for fitting on the end of a leg of rectangular cross section and acting as a boot to permit sliding of the leg across a substrate and to protect the leg from damage, and rotting and comprising:

a wall structure shaped to embrace the leg around its end defining, in plan, a rectangular shape adapted to fit snugly on said leg;

a floor secured to said wall structure;

a plurality of parallel spaced apart ribs formed on said floor said ribs being spaced apart from one another, and defining liquid flow channels therebetween;

said channels being located along an incline from one end to the other of said floor, whereby to promote liquid flow to one end of said channels;

a drain hole formed in said floor for drainage of liquid flowing along said channels; and, a generally convex lower surface formed on said floor, for standing on a substrate, said convex surface defining a central area of maximum depth, curving smoothly upward and outward in both transverse and longitudinal axes.

2. The leg base for outdoor furniture for fitting on the end of a leg as claimed in claim 1 wherein said wall structure comprises side walls surrounding said leg and defining a well there within.

3. The leg base for outdoor furniture for fitting on the end of a leg as claimed in claim 1 wherein said wall structure comprises two side walls and two end walls defining a well having a generally rectangular cross section.

4. The leg base for outdoor furniture for fitting on the end of a leg as claimed in claim 1 including a plurality of spaced apart column members formed on said wall structure, for wedging engagement with a said leg.

5. The leg base for outdoor furniture for fitting on the end of a leg as claimed in claim 4 wherein said side and ends walls are arranged to define a central wall axis said axis being non perpendicular.

6. The leg base for outdoor furniture for fitting on the end of a leg as claimed in claim 1 wherein said generally convex surface defines a longitudinal central axis, and wherein said area of maximum depth is located along said central axis.

* * * * *